United States Patent [19]

Wehrli, III et al.

[11] 4,278,150

[45] Jul. 14, 1981

[54] ELEVATOR SYSTEM

[75] Inventors: Henry A. Wehrli, III; Dirk J. Boomgaard, both of Monroeville, Pa.; Alvin O. Lund, deceased, late of Little Falls, N.J., by Helen B. Lund, executrix

[73] Assignee: Westinghouse Electric Corp., Pittsburgh, Pa.

[21] Appl. No.: 41,449

[22] Filed: May 22, 1979

[51] Int. Cl.[3] ..... B66B 1/30

[52] U.S. Cl. ..... 187/29 R

[58] Field of Search ..... 187/29; 318/740, 741, 318/757, 758, 760, 744

[56] References Cited

U.S. PATENT DOCUMENTS

| | | | |
|---|---|---|---|
| 3,379,983 | 4/1968 | Harris | 328/151 |
| 3,596,192 | 7/1971 | Lutes | 328/165 |
| 3,687,235 | 8/1972 | Mitsui et al. | 187/29 |
| 3,876,918 | 4/1975 | Komyro et al. | 318/203 |
| 4,042,069 | 8/1977 | Ohira et al. | 187/29 |
| 4,068,741 | 1/1978 | Ficheux et al. | 187/29 |
| 4,094,385 | 6/1978 | Maeda et al. | 187/29 |
| 4,114,084 | 9/1978 | Glaudel et al. | 322/38 |
| 4,213,517 | 7/1980 | Ando | 187/29 |
| 4,220,221 | 9/1980 | Gingrich | 187/29 |

*Primary Examiner*—J. V. Truhe
*Assistant Examiner*—W. E. Duncanson, Jr.
*Attorney, Agent, or Firm*—D. R. Lackey

[57] ABSTRACT

A traction elevator system including an elevator car driven by a drive arrangement having electrically isolated high and low speed components. Fixed AC and controllable DC voltages are selectively applied to the high and low speed components, respectively, at predetermined portions of the run, to control the drive torque to provide smooth operation of the elevator car.

35 Claims, 16 Drawing Figures

TO SUMMING AMP 224
FROM OR 218
222
240
241
239
249
247
245
243
238
236
235
234

A.C. VOLTAGE
MOTOR R.P.M.
D.C. CURRENT
TIME
ST
226
228
230
232

OPTICAL SWITCH
90
92
256
248
254
258
260
250
263

ELEVATOR SYSTEM

BACKGROUND OF THE INVENTION

1. Field of the Invention

The invention relates in general to elevator systems, and more specifically to drive arrangements for elevator systems having an AC drive motor.

2. Description of the Prior Art

Traction elevator systems which operate at speeds above about 500 feet per minute are directly driven by a DC motor. Systems which operate below 500 feet per minute utilize a reduction gear and either an AC or a DC drive motor. DC drive motors provide good control and thus a smooth ride and are usually used in geared applications when ride quality is important. DC drives for elevators are more costly than AC drives, however, and considerable effort has been directed to improving the performance of AC drives for elevators using thyristor control. However, the more sophisticated the AC control, the less its cost advantage over the DC drive. Thus, it would be desirable to provide a new and improved elevator system having an AC drive arrangement which provides a smooth ride while utilizing a minimum of feedback and AC control.

SUMMARY OF THE INVENTION

Briefly, the present invention is a new and improved traction elevator system having a drive arrangement which includes electrically isolated high and low speed components. A fixed AC line voltage is applied to the high speed component, and a controllable DC voltage is selectively applied to the low speed component. The DC applied to the low speed component provides torque control which enables a smooth ride to be achieved without controlling the AC line voltage.

In a preferred embodiment of the invention, initial car movement at the start of a run is achieved by simultaneous application of the AC and DC voltages to the high and low speed components, respectively. The DC voltage is controlled to start at a value which results in the system braking torque exceeding the motoring torque. The system braking torque includes the DC control of the low speed component and the system inertia which is relatively large when the elevator car is stationary and when it is moving at very low speeds, due to the reduction gear. The DC voltage is then smoothly ramped downwardly with time, to reduce the system braking torque below the motoring torque, to provide a smooth initial car movement without requiring feedback control, as the resultant torque starts at zero and smoothly increases in magnitude.

A low cost speed pattern stored in a read-only memory (ROM) efficiently controls the deceleration phase of a run with a single pattern, regardless of the length of the run. The pattern is initiated a predetermined distance from the desired stopping point, and it starts at a value higher than the maximum possible car speed. The blending of the car speed with this single speed pattern is accomplished without uncomfortable jerk or pattern overshoot from any car speed, by an anticipation control function. This function initiates DC dynamic braking on the low speed component, while AC is still being applied to the high speed component, before the actual car speed intersects the speed pattern. The difference between the actual and pattern speeds, modified by a factor responsive to the rate of change of car speed, is used to determine the magnitude of the dynamic braking torque. True or actual coincidence of the car speed and the speed pattern is used to provide a signal which disables the anticipation function and disconnects the AC line voltage from the high speed component. A pulse wheel driven in synchronism with car movement produces a distance pulse for each predetermined small increment of car movement, such as 0.02 inch. These pulses are counted in a binary counter when the speed pattern is initiated, with the counter addressing the ROM to provide the desired speed at each location of the elevator car as it approaches the desired stopping point. The memory capacity required in the ROM is reduced without sacrificing smooth pattern control in the pattern "flair" as the stopping point is approached, by dividing the distance pulses such that only every Nth pulse is applied to the clock memory until the elevator car reaches a predetermined distance from the stopping floor determined by the count on the counter. At this point, every distance pulse is applied to the memory to provide the flair portion of the deceleration speed pattern.

A low cost, yet essentially ripple-free signal responsive to actual car speed is provided from the distance pulses, using a frequency to voltage converter and a sample and hold function to remove the ripple. The ripple is sampled at the same relative point, regardless of frequency, by an arrangement which generates constant width pulses from the pulse wheel, and sample timing from the pulse wheel.

The DC voltage applied to the low speed component is controlled by an error or difference signal responsive to the difference between the actual speed of the elevator car and the speed pattern signal. At a predetermined small distance from the stopping floor, determined by the output of the ROM, the DC voltage applied to the low speed component is smoothly ramped upwardly, without feedback, to smoothly stop the elevator car at floor level without requiring the application of the electromechanical brake while the elevator car is moving. A predetermined time after the ramp begins, the electromechanical friction brake is automatically applied.

If releveling is required, the elevator car is started via simultaneous application of AC and DC to the high and low speed components, as described relative to the start of a run. However, the electromechanical friction brake is maintained in its applied condition, and the DC starting ramp voltage, instead of being ramped to zero, is reduced only to that point which provides the desired releveling speed. Thus, releveling is accomplished "through the brake". When the leveling control indicates the elevator car is back to floor level, the AC and DC voltages are terminated and the driving torque is thus reduced below the braking torque exerted by the electromechanical friction brake, stopping the car precisely at floor level.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENTS

Figure 1:
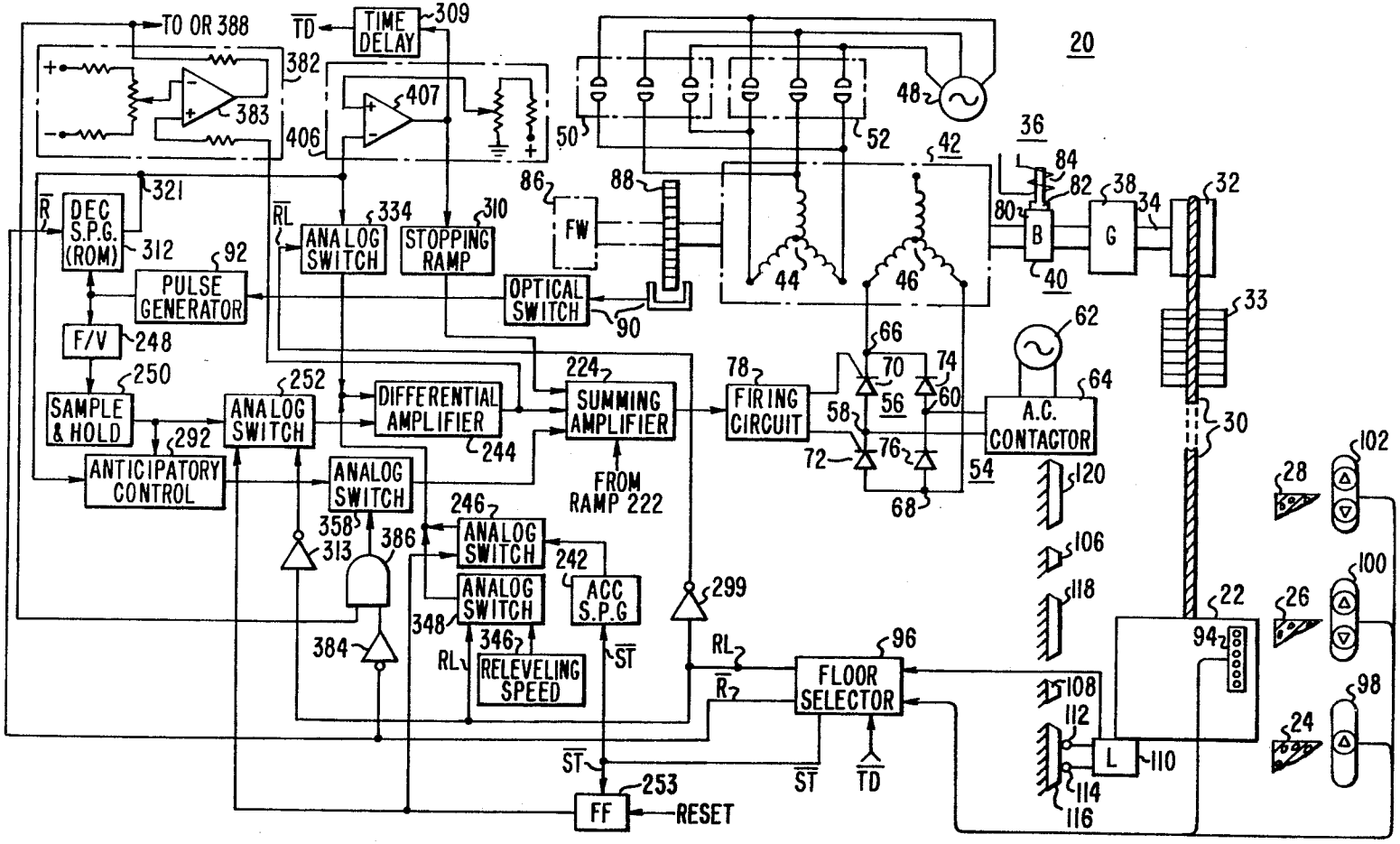
FIG. 1 is a partially schematic and partially block diagram of an elevator system constructed according to the teachings of the invention.
Figure 2:
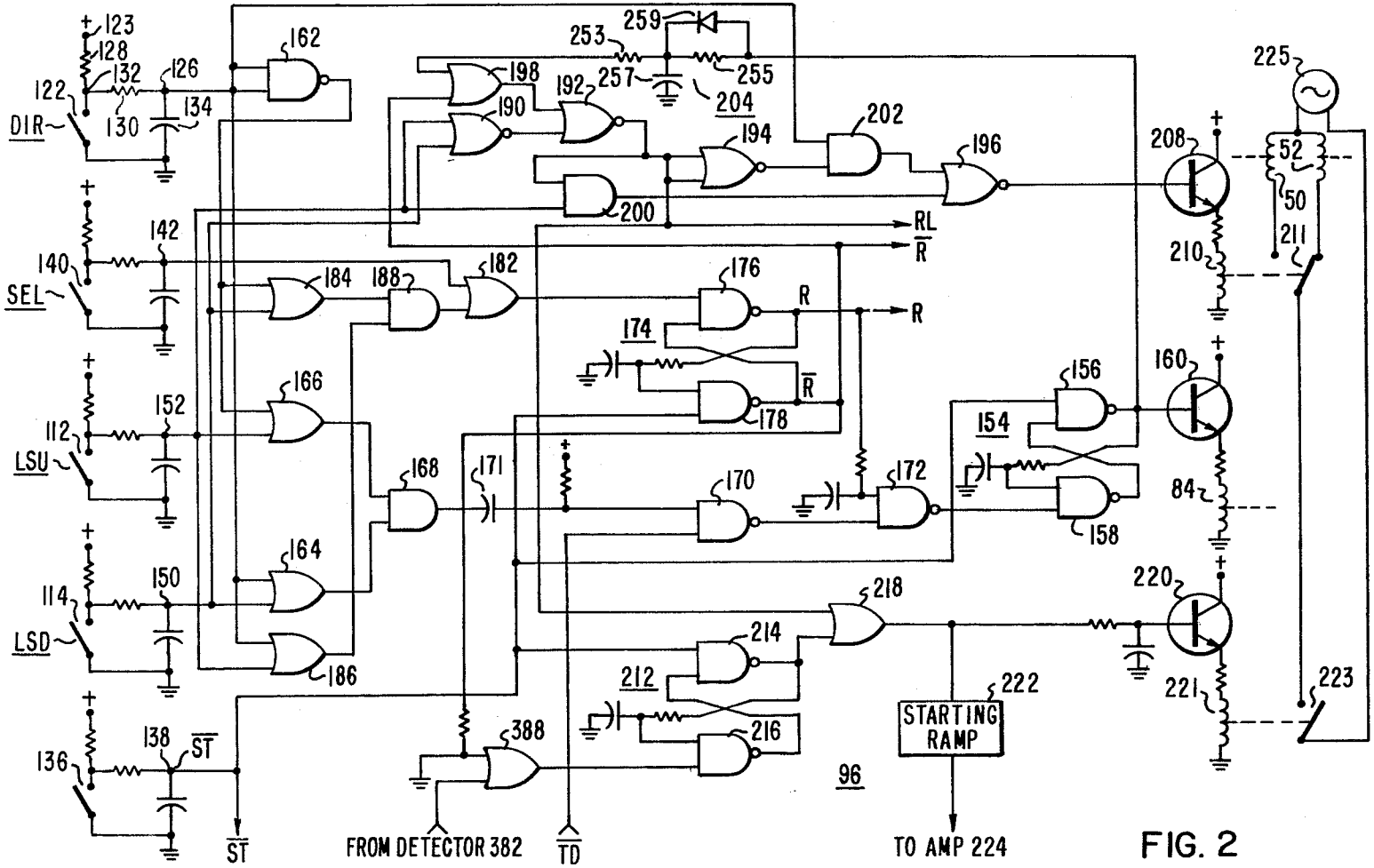
FIG. 2 is a schematic diagram of a circuit which may be used for the floor selector function shown in block form in FIG. 1.

Referring now to the drawings, and to FIG. 1 in particular, there is shown a partially schematic and partially block diagram of an elevator system 20 constructed according to the teachings of the invention. Elevator system 20 includes an elevator car 22 mounted for guided vertical movement in a building to serve the floors therein, such as floors 24, 26 and 28. Elevator car 22 is supported by a plurality of wire ropes 30 which are reeved over a drive sheave 32 and connected to a counterweight 33. Drive sheave 32 is mounted on an output shaft 34 of a traction elevator drive machine 36 which includes a reducing gear 38, an electromechanical friction brake 40, and an AC drive system 42. The AC drive system 42 includes electrically isolated high and low speed components 44 and 46, respectively. In a preferred embodiment of the drive system 42, a two speed, three-phase AC induction motor having separate high and low speed three-phase windings is utilized, and the invention will be described from this viewpoint. However, two separate motors on the same shaft, or coupled to the same shaft, may be used to provide the electrically isolated high and low speed functions. The high speed component or winding 44, such as a four pole winding, is connected to a three-phase source 48 of alternating line potential via up and down AC contactors 50 and 52, respectively. The operating coils for the up and down AC contactors, and a direction relay for selecting the proper contactor, are shown in FIG. 2. The low speed component or winding 46, such as a sixteen pole winding, is connected to a source 54 of DC potential. For example, source 54 may be a controllable single-phase bridge rectifier circuit 56 having AC input terminals 58 and 60 connected to a single-phase source 62 of alternating potential via an AC line contactor 64. Bridge 56 has DC output terminals 66 and 68 connected across any two, or all three, phases of the three-phase low speed winding 46. Bridge rectifier 56 includes four solid state rectifier elements 70, 72, 74 and 76, with two of the elements being thyristors, such as elements 70 and 72. Thyristors 70 and 72 have gate electrodes connected to a power controller or firing circuit 78, such as the firing circuit shown in U.S. Pat. No. 3,898,550, which is assigned to the same assignee as the present application.

The electromechanical brake 40 is fail-safe, including a drum 80 and a brake shoe 82 which is spring applied and electrically released via a brake coil 84.

A flywheel 86 is shown mounted on shaft 34 of the drive machine 36. It is shown in phantom, as it is not required in certain embodiments of the invention.

A pulse wheel 88 is part of a digital feedback system which includes a pickup 90 disposed to detect movement of the elevator car 22 through the effect of circumferentially spaced openings or teeth in a plate member, such as a toothed wheel. The openings or teeth in the plate member are spaced to cause pickup 90 to provide a distance pulse for each standard increment of car travel, such as a pulse for each 0.02 inch of car travel. Pickup 90 may be of any suitable type, such as magnetic or optical, with an optical switch being illustrated. The pulse output of the optical switch 90 is applied to a pulse shaper 92, and the pulses provided by the pulse shaper 92 are used to develop information regarding the position and speed of the elevator car 22, as will be hereinafter explained. The pickup 90 provides a first train of pulses which represents mechanical motion of the elevator car 22, with velocity and distance being analogous to pulse density or rate and pulse numer, respectively. A certain aspect of the invention provides a substantially ripplefree analog signal responsive to car speed from the output of the pulse wheel. However, distance pulses may be developed in any other suitable manner, such as via a rotating drum; or, a linearly actuated transducer may be used, such as a tape having openings, and a detector, mounted for relative movement.

Car calls, as registered by a push-button array 94 in the elevator car 22 are directed to a floor selector 96 via conductors in a traveling cable. Hall calls, as registered by push buttons mounted in the hallway at each floor entrance, such as push-button stations 98, 100 and 102, are also directed to the floor selector 96.

Car position relative to a floor, such as to determine precisely when the elevator car 22 is predetermined distance D from a floor, may be determined by (a) cams and limit switches, (b) magnets and magnetically operated switches, (c) inductor relays and metallic plates, or the like. Depending upon the type of position indicator selected, a device mounted on the elevator car 22 detects when the position D is reached, as signaled by indicators mounted in the hoistway which detect distance D for downward and upward car travel relative to the various floors, such as distance cams 106 and 108 for floor 26. Distance cams 106 and 108 indicate distance D relative to floor 26 for downward, and upward car travel, respectively. If the elevator car has a car or hall call for the next floor at which it can make a normal stop, or the floor the car is approaching is a terminal floor, or the elevator car is to be parked, the floor selector 96 provides a signal for the control circuitry which enables the control to determine when position D relative to the stopping or target floor is reached, as will be described more fully with reference to FIG. 2.

After the elevator car 22 stops at floor level, the mechanical brake 40 is set. However, change in car load may cause the position of the elevator car 22 to change because of stretch or contraction of the ropes 30. The need for releveling is detected by control 110 mounted on the elevator car 22 which cooperates with suitable indicators at each floor. For example, as illustrated, control 110 includes switches 112 and 114, and the floor level indicators may include a cam, such as cams 116, 118 and 120 associated with floors 24, 26 and 28, respectively. When the elevator car is at floor level, both switches 112 and 114 will be in the same condition, i.e., closed. Subsequent actuation of switch 114 indicates releveling is required in the upward direction. Subsequent actuation of switch 112 indicates releveling is required in the downward direction. The conditions of switches 112 and 114 are sent to the floor selector 96 via the traveling cable.

Switches 112 and 114, and the distance cams mounted in the hoistway, also provide an indication of distance D. For example, cam 106 indicates distance D for floor 26 via switch 114 when the elevator car is moving downwardly, and cam 108 indicates distance D for floor 26 via switch 112 when the elevator car is moving upwardly.

The various aspects of the invention will be described while setting forth the operation of the elevator system 20 as it goes through a complete run, i.e. from a time when the elevator car is sitting idle at a floor, through the start phase which prepares the elevator car to make a run, and then through the acceleration, constant speed, deceleration, and releveling phases. FIG. 1 will be used to broadly describe the various functions, with the detailed schematics and graphs being referred to when appropriate to further describe the inventive aspects of the elevator system 20. Those functions which are common in elevator systems and which may be conventional will not be described in detail, in order to limit the complexity of the drawings and the specification.

More specifically, the elevator car will first be assumed to be standing at a floor, and a call for elevator service is initiated on the car call array 94, or at a push-button station in the hallway associated with a floor.

Referring now to FIG. 2, FIG. 2 illustrates certain functions of the floor selector 96 in detail. The floor selector 96 makes certain decisions based upon calls for elevator service and the position of the elevator car, such as by selecting a travel direction, issuing a start signal, and issuing a "floor selected" signal when the moving elevator car is to stop at the next floor. These decisions are indicated by switch or contact closures in FIG. 2.

More specifically, switch 122 is responsive to the selection of a travel direction, with switch 122 being closed for the up-travel direction, and open for the down-travel direction. A source 124 of unidirectional potential is connected to an output terminal 126 via serially connected resistors 128 and 130. Switch 122 is connected from the junction 132 between resistors 128 and 130 to ground, and a capacitor 134 is connected from output terminal 126 to ground. Thus, when an up-travel direction is selected, switch 122 is closed and output terminal 126 is a logic zero. When switch 122 opens to signify a down-travel direction has been selected, output terminal 126 goes to a logic one.

In like manner, a "start" signal $\overline{ST}$ is issued by momentarily providing a logic zero at output terminal 138 via a switch 136.

A "floor selected" signal is generated by a switch 140 which closes to provide a logic zero signal at an output terminal 142 when the elevator car is to stop at the next floor. The issuance of the floor selected signal enables the subsequent operation of one of the switches 112 or 114 to prepare the elevator car to enter the deceleration or slow-down phase of the run.

When the elevator car 22 is at floor level, switches 112 and 114 are both closed, providing logic zero signals at output terminals 152 and 150, respectively. If the elevator car 22 moves away from floor level in a downward direction, such as due to rope stretch, switch 114 opens to provide a logic one at output terminal 150. If the car moves away from floor level in an upward direction, such as due to rope contraction, switch 112 opens to provide a logic signal at output terminal 152.

When a run is to be made, switch 136 momentarily provides a logic zero signal to lift the electromechanical brake 40 and to start the elevator car smoothly away from the floor. Brake 40 is controlled by a brake memory 154, such as a flip-flop formed of cross-coupled NAND gates 156 and 158. Terminal 138 of the start circuit is connected to an input of NAND gate 156. The momentary logic zero signal from terminal 138 sets flip-flop 154 to turn on a transistor 160 and provide current for the brake coil 84, to lift the brake.

The reset side of flip-flop 154 is controlled by a logic circuit which includes OR gates 164 and 166, AND gate 168, and NAND gates 170 and 172. A NAND gate 162 is connected between output terminal 126 and an input of OR gate 166. The other input to OR gate 166 is connected to output terminal 152. OR gate 164 has one of its inputs connected to output terminal 126 and its other input is connected to output terminal 150. The outputs of OR gates 164 and 166 are connected to the two inputs of AND gate 168, and the output of AND gate 168 is connected to an input of NAND gate 170 via a capacitor 171. The other input of NAND gate 170 receives a signal $\overline{TD}$ from FIG. 1. The output of NAND gate 170 is connected to one input of NAND gate 172, and the other input is connected to an output of a reset memory 174. The output of NAND gate 172 is connected to an input of NAND gate 158. When this input to NAND gate 158 goes low, flip-flop 154 is reset and the electromechanical brake 40 is set or applied.

Reset memory 174 ensures that the control associated with the deceleration phase of the run remains reset until point D is reached associated with the stopping floor. Reset memory 174 may be a flip-flop formed of cross-coupled NAND gates 176 and 178. A low start signal $\overline{ST}$ from output terminal 138 resets flip-flop 174 to provide a high signal $\overline{R}$ and a low signal R. The low signal R ensures that the brake flip-flop 154 remains set and the brake picked up until the slowdown phase of the run is initiated. When the reset memory 174 is switched from its reset to its condition, it enables the brake flip-flop 154 to be reset in response to a low signal $\overline{TD}$.

A logic circuit sets reset flip-flop 174 when the elevator car arrives at point D associated with a floor at which the elevator car is to make a stop. An OR gate 182 has one input connected to output terminal 142 and its output is connected to an input of NAND gate 176. Thus, when the elevator car should not stop at the next floor, terminal 142 is high and flip-flop 174 remains reset. If the car is to stop at the next floor, the input to OR gate 182 from terminal 142 will be low, enabling flip-flop 174 to be set when the other input to OR gate 182 goes low. OR gates 184 and 186 and AND gate 188 control the other input to OR gate 182. This input to OR gate 182 goes low when point D is reached, signified by a momentary logic zero from one of the switches 112 or 114. When the elevator car is moving up, closure of switch 112 signifies point D, and when the elevator car is moving down, closure of switch 114 signifies point D. When the output of OR gate 182 goes to logic zero, flip-flop 174 is set, enabling NAND gate 172 to set the electromechanical brake when signal $\overline{TD}$ subsequently goes low. The high signal R and the low signal $\overline{R}$ now release certain of the control associated with the deceleration phase of the run, as will be hereinafter explained.

A direction and releveling logic circuit includes NOR gates 190, 192, 194, and 196, an OR gate 198, and AND gates 200 and 202. The inputs to NOR gate 190 are connected to output terminals 150 and 152, and the output of NOR gate 190 is connected to an input of NOR gate 192. One input to OR gate 198 is connected to the output of NAND gate 156 via a unidirectional delay circuit 204. The other input to OR gate 198 is connected to the output of NAND gate 178. The output of OR gate 198 is connected to the remaining input of NOR gate 192. The output of NOR gate 192 provides a signal RL which initiates releveling when it is high. Signal RL is also used to disable the deceleration speed pattern generator when releveling, and to substitute a fixed releveling speed pattern.

The direction and releveling logic circuit also includes an NPN transistor 208, and a direction relay coil 210. Coil 210 controls the position of a direction switch 211. One input of AND gate 202 is connected to output terminal 126, it other input is connected to receive signal RL at the output of NOR gate 192 via NOR gate 194 which is connected as an inverter. The output of AND gate 202 is connected to one input of NOR gate 196. One input of AND gate 200 is connected to receive signal RL, its other input is connected to output terminal 152, and its output is connected to the remaining input of NOR gate 196. The output of NOR gate 196 is connected to the base electrode of NPN transistor 208. A source of unidirectional potential is connected to the collector electrode, and the emitter is connected to ground via the direction coil 210. The direction coil is deenergized when the travel direction is down, selecting down contactor 52, and energized when the travel direction is up, selecting up contactor 50.

When the start signal at terminal 138 goes low to lift the brake 40, the low signal $\overline{ST}$ is also applied to a drive motor memory 212. Memory 212 may be a flip-flop formed of cross-coupled NAND gates 214 and 216. The low signal $\overline{ST}$ causes NAND gate 214 to output a logic one to an OR gate 218. OR gate 218 outputs a logic one signal which turns on an NPN transistor 220 to energize the operating coil of the contactor selected by the direction relay 210 and direction switch 211, which in turn energizes the high speed component 44 of the AC drive machine 42.

The various logic functions of floor selector 96 shown in FIG. 2 will now be described in greater detail. When power is initially turned on, RC circuits associated with the brake, reset and motor memories 154, 174 and 212, respectively, insure that they are initialized to their reset conditions. The brake flip-flop 154 applies a logic zero to transistor 160, and thus the brake remains in its applied condition. Signals $\overline{R}$ and R are high and low, respectively, at the output of the reset memory 174. The output of NAND gate 214 of the motor flip-flop 212 is low, to prevent the high speed component 44 of the drive machine 42 from being energized.

We will first consider travel in the upward direction. For the up direction, the direction switch 122 will be closed by the floor selector 96. Momentary closure of the "start" switch 136 provides a true signal $\overline{ST}$ which triggers the motor flip-flop 212 causing the output of NAND gate 214 to go high which is passed by OR gate 218 to transistor 220, turning it on. A motor relay 221 is energized which closes a switch 223 to energize the up contactor 50 via a source of alternating potential 225. The floor selector 96 would have previously selected contactor 50 via logic which will be hereinafter described. The starting ramp 222 will also be activated via the high output from OR gate 218, with the starting ramp function being hereinafter described in detail.

The low signal $\overline{ST}$ also triggers the brake flip-flop 154 which pulls in the brake relay 84 and releases the mechanical brake 40. The car will thus start smoothly away from the floor when the starting ramp reduces the DC current to the point at which a motoring torque is developed which exceeds the total braking torque of the system.

The low output signal R from the reset flip-flop 174, blocks NAND gate 172 and makes the brake flip-flop impervious to NAND gate 170.

As long as the selector switch 140 stays open, all closures of switches 112 and 114 are ignored by the reset flip-flop 174 as the elevator car travels upwardly. With the upward travel direction, switch 122 will be closed and gate 162 applies logic one signals to OR gates 184 and 166, ignoring closures of switches 112 and 114 at these gates. Although gates 164 and 186 will pass closure of switches 112 and 114, since the closed switch 122 applies logic zeros to these gates, NOR gate 182 blocks closures of switch 112 from reaching the reset flip-flop 174, as the output of NOR gate 182 is high due to the open selector switch 140. Since the reset flip-flop 174 is held "reset", NAND gate 172 is not affected by contact closures which reach gate 172 via gates 164, 177, 168 and 170.

When the next floor at which the elevator car can make a normal stop is the floor at which the car should stop, the floor selector 96 will close the selector switch 140. Now, the first momentary closure of switch 112 after the closing of selector switch 140 will pass through OR gate 182 which sets the reset flip-flop 174, causing signal R to go high and signal $\overline{R}$ to go low. The setting of the reset flip-flop 174 starts the deceleration or slowdown phase of the run, which will be hereinafter described.

The description for downward travel is similar to that for upward travel, except with the direction switch 122 open, OR gates 164 and 186 are blocked, and OR gates 166 and 184 are active. Thus, the momentary closure of switch 114 following the closing of the selector switch 140 will trigger the reset flip-flop 174 to initiate slowdown.

The output of OR gate 218 shown in FIG. 2, in addition to energizing the high speed component 44, simultaneously activates a starting ramp function 222. As shown in FIG. 1, the starting ramp function is applied to a summing amplifier 224. The output of summing amplifier 224 controls the DC voltage applied to the low speed component 46 via the firing circuit 78 and rectifier 54. The starting ramp function causes a large direct current to flow in the low speed component, with the initial magnitude of this current being selected such that the system braking torque exceeds the motoring torque being provided by the energized high speed component. The DC voltage applied to the low speed component is smoothly ramped downwardly with time, without feedback, such that when the motoring torque exceeds the system braking torque, the car will smoothly accelerate away from the floor as the resultant torque smoothly increases from zero.

Figure 3:
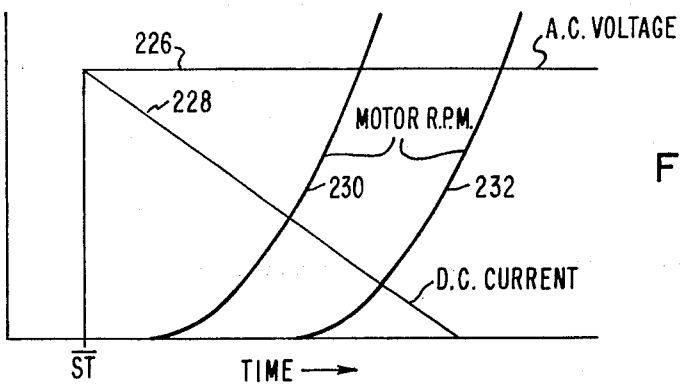
FIG. 3 is a graph which illustrates the starting ramp function.

FIG. 3 is a graph which illustrates the effect of the starting ramp function. When the start signal $\overline{ST}$ is produced, a fixed AC voltage is applied to the high speed component, indicated by line 226 in FIG. 3. The DC current flowing in the low speed component is indicated by ramp 228. The current ramp is smoothly reduced to zero with time. A ramp time of about one-half to one second is suitable, but other values may be used. The resulting motor RPM is responsive to the specific type of load on the elevator car. With an overhauling load, the elevator car will start away from the floor sooner than with a hauling or motoring load. Curves 230 and 232 indicate the motor RPM for overhauling and hauling loads, respectively.

Figure 4:
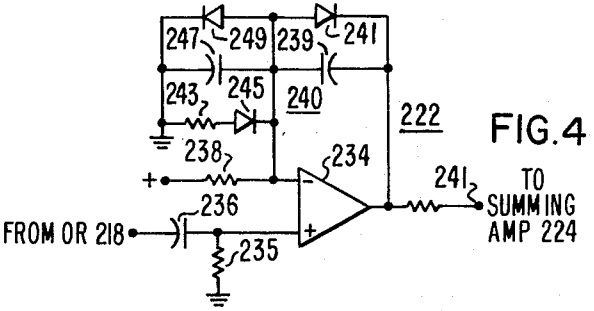
FIG. 4 is a schematic diagram of a circuit which may be used for the starting ramp function shown in block form in FIG. 1.

FIG. 4 is a schematic diagram which illustrates a starting ramp circuit which may be used for performing the starting ramp function 222 shown in FIG. 2. The signal from OR gate 218 is applied to the noninverting input of an operational amplifier (OP AMP) 234 via a differentiating network which includes a resistor 235 and a capacitor 236. A unidirectional potential is applied to the inverting input of OP AMP 234 via a resistor 238. A capacitor 239 is connected from the output of OP AMP 234 to the inverting input, and a diode 241 is connected across capacitor 241 such that its anode electrode is connected to the inverting input. A resistor 243 and diode 245 are serially connected between ground and the inverting input, with the cathode electrode of diode 245 connected to the inverting input. A capacitor 247 is connected from the inverting input to ground, and a diode 249 is connected from the inverting input to ground. The anode of diode 249 is connected to the inverting input.

Initially, current from the positive source of unidirectional potential is applied to the inverting input via resistor 238, driving the output of OP AMP 234 down until diode 241 starts to conduct. Thus, the output voltage is −0.7 volt, or the drop across diode 241, and the charge on capacitor 239 is 0.7 volt. When the signal from OR gate 218 in FIG. 2 goes high, the differentiating action of capacitor 236 and resistor 235 provides a pulse, the positive going edge of which drives the output voltage of OP AMP 234 to the positive supply voltage, and capacitor 239 charges up to the supply voltage via diode 249. When the pulse terminates, the current through resistor 243 will start to discharge capacitor 239, ramping the output voltage down to −0.7 volt.

The starting ramp 222 is also used during releveling, which will be hereinafter explained. During releveling it is desirable to terminate the DC ramp voltage when the AC supply is disconnected from the drive motor. Resistor 243, diode 245 and capacitor 247 provide a ramp abort function. When the output of OR gate 218 returns to zero to drop the AC, the negative going edge of the OR output is differentiated by capacitor 236 and resistor 235, driving the output of op amp 234 negative and rapidly discharging capacitor 239 through resistor 243 and diode 245 until the output is again −0.7 volt.

Thus, a smooth start is provided for an AC driven elevator car, without the necessity of feedback. In a preferred embodiment of the invention, feedback control over elevator car speed is provided only during the deceleration phase of the run. However, pattern control may be provided in any of the other phases of the run, if desired, such as in the acceleration and rated speed phases, or in the acceleration phase, without speed control in the full or rated speed phase. For example, referring to FIG. 1, an acceleration speed pattern function 242 may be activated by the start signal $\overline{ST}$. This function may simply be provided by an RC charging circuit, providing an acceleration speed pattern which is time based. The output of the acceleration speed pattern generator 242 is applied to an input of a differential amplifier 244 via an analog switch 246, such as RCA's CD4066.

A signal responsive to actual car speed is developed from the pulse wheel 88, according to the teachings of the invention, by a pulse generator 92, a frequency to voltage converter 248, and a sample and hold circuit 250. The output of the sample and hold 250 is applied to an input of the differential amplifier 244 via an analog switch 252. The analog switches 246 and 252 may be controlled by a memory or flip-flop 253 which is set by start signal $\overline{ST}$ to provide a logic one signal which renders the analog switches 246 and 252 conductive. Flip-flop 253 may be reset by an OP AMP comparator responsive to the output of the sample and hold 250. The reference input to the comparator would be set to indicate the speed at which acceleration pattern control is to be terminated. If the acceleration speed pattern generator 242 is to also control the rated or maximum speed, the reset input of flip-flop 253 would be connected to respond to the elevator car reaching point D relative to the stopping floor and thus may be reset by reset signal $\overline{R}$ from FIG. 2.

Figure 5:
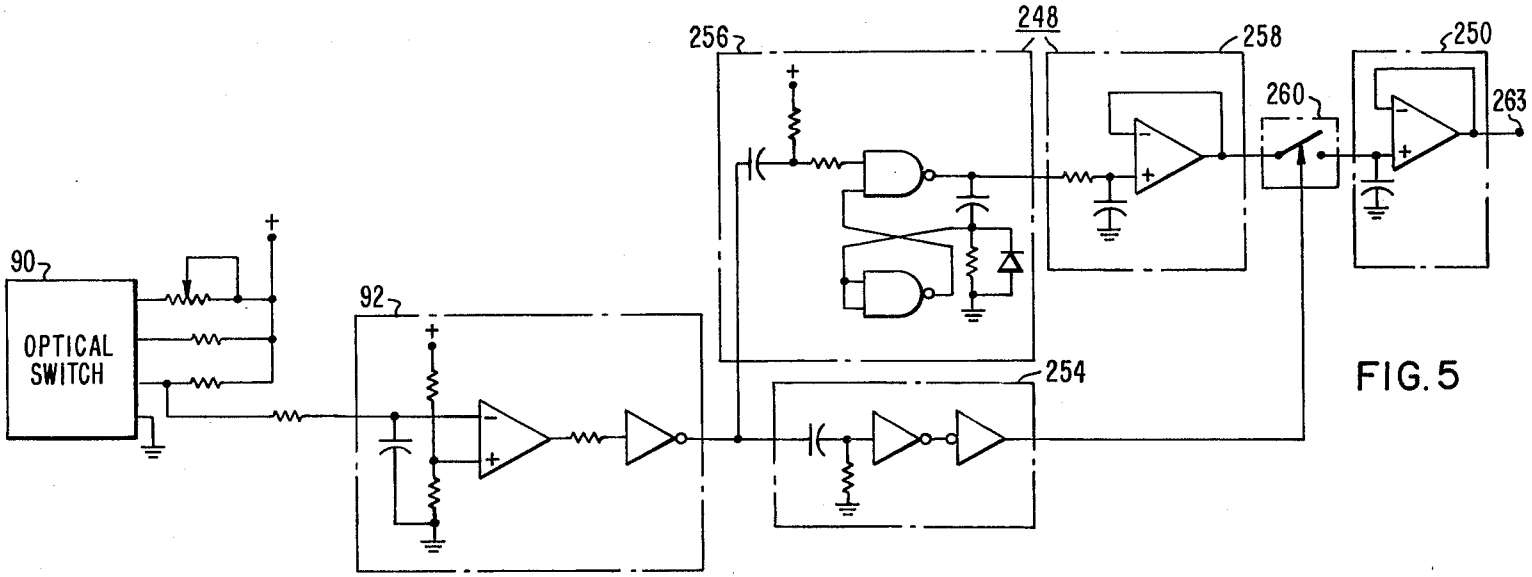
FIG. 5 is a schematic diagram of a circuit for providing a substantially ripple-free analog signal responsive to the actual car speed, using a pulse wheel as the speed intelligence, which circuit may be used for the pulse generator, tachometer, and sample and hold functions shown in block form in FIG. 1.

FIG. 5 is a schematic diagram of an arrangement for deriving an analog signal responsive to actual car speed, which may be used for the functions shown in block form in FIG. 1 starting with the optical switch 90 through the sample and hold 250. The optical switch 90 may be purchased from HEI. The pulse shaper 92 may be an OP AMP comparator, with the optical switch 90, the toothed wheel 88, and the pulse shaper 92 functioning as a shaft encoder which provides a squarewave output, which will be referred as a first train of pulses. The width of the pulses in the first train of pulses varies in response to the speed of the elevator car. The first train of pulses provides the timing for generating a second train of pulses, and for keying the timing of a sample and hold timing function. The second train of pulses may be provided by a frequency to voltage converter 248, and the timing function for developing the sample and hold timing may be provided by a timing circuit 254. The frequency to voltage converter 248 may be purchased, such as INTECH's A848, or it may be constructed from a monostable 256 and an integrator 258. The monostable 256 is triggered by a selected edge of each of the pulses of the first pulse train, providing a second pulse train having constant width pulses. The pulses of the second pulse train are integrated by an integrator 258 to provide a unidirectional signal having a D.C. component and a ripple component, both of which are responsive to the speed of the elevator car. The output of the integrator 258 is applied to the sample and hold circuit 250 via an analog switch 260. The timing function 254, which develops its timing in response to the output of the pulse generator 92, controls the analog switch 260.

Figure 6:
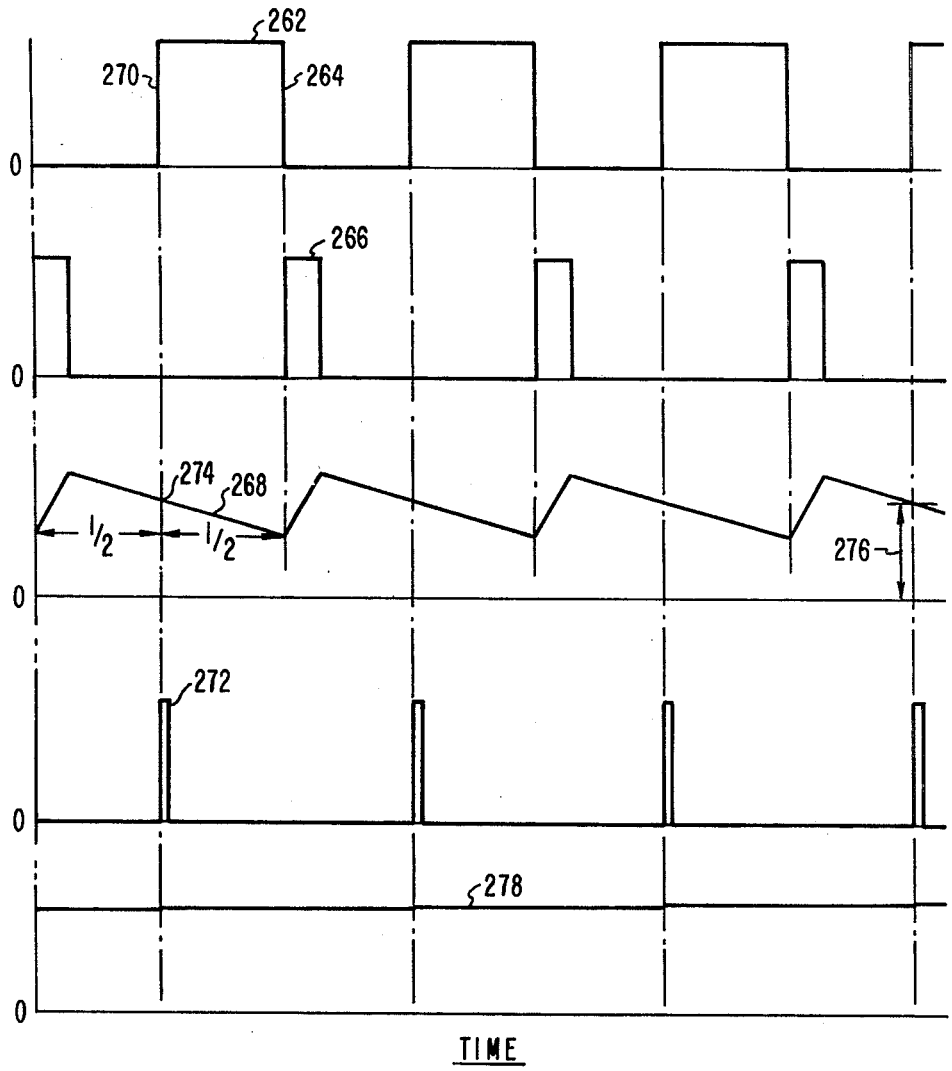
FIG. 6 is a graph which illustrates the operation of the sample and hold function in the actual car speed signal arrangement shown in FIG. 5.

FIG. 6 is a graph which illustrates the operation of the circuitry shown in FIG. 5. The curve or squarewave 262 illustrates the squarewave output of the shaft encoding function. One edge of each of the squarewave pulses is used to trigger the monostable 256 and the other edge is used to trigger the sample and hold timing function 254. Thus, with this arrangement, the sample is taken precisely at the midpoint of the ripple, regardless of the pulse rate from the shaft encoding function. For example, edge 264 triggers the monostable 256 to provide a constant width pulse 266, with the pulses 266 forming the second train of pulses which are integrated by the integrator 258. The output of the integrator 258 provides a unidirectional signal 268 having a magnitude responsive to the pulse rate and thus to the speed of the car. Signal 268 has a ripple component or frequency responsive to the pulse rate, which is objectional in the comparison circuits which follow in the speed feedback loop. A low pass filter for removing the ripple is not suitable because a low pass filter has a long time constant, especially when applied to remove the ripple to the degree required, and is therefore slow in responding to speed changes. The present invention provides a very fast responding actual speed indicator which has very little ripple, but utilizing the arrangement set forth in FIG. 5. The sample and hold timing function 254 is triggered by the remaining edge 270 pf the squarewave 262 to provide a timing pulse which samples the ripple at the midpoint 274 of the ripple. The magnitude 276 of the ripple at the midpoint is a true average of the ripple, providing an output voltage waveform 278. The ripple may also be sampled at some point other than the midpoint, using the pulses of the first pulse train as a reference, if desired, as long as the sampling point is always at the same relative position. The speed indication would be offset from the average, but it would be a constant offset.

If the elevator speed is constant, the output of the sample and hold 250 will be constant. With a changing car speed, the output of the sample and hold 250 will step slightly to a different constant value at each timing pulse 272, to reflect the speed change from cycle to cycle. The speed measuring arrangement shown in FIG. 5, using INTECH's A848 frequency to voltage generator, has been successfully used to measure speed from zero to 1800 RPM (0 to 3600 Hz.) with less than 2 mv. ripple and 3 msec. response.

The speed measuring arrangement of FIG. 5 further improves response time by permitting a relatively large ripple in the output of the integrator function 258.

Figure 7:
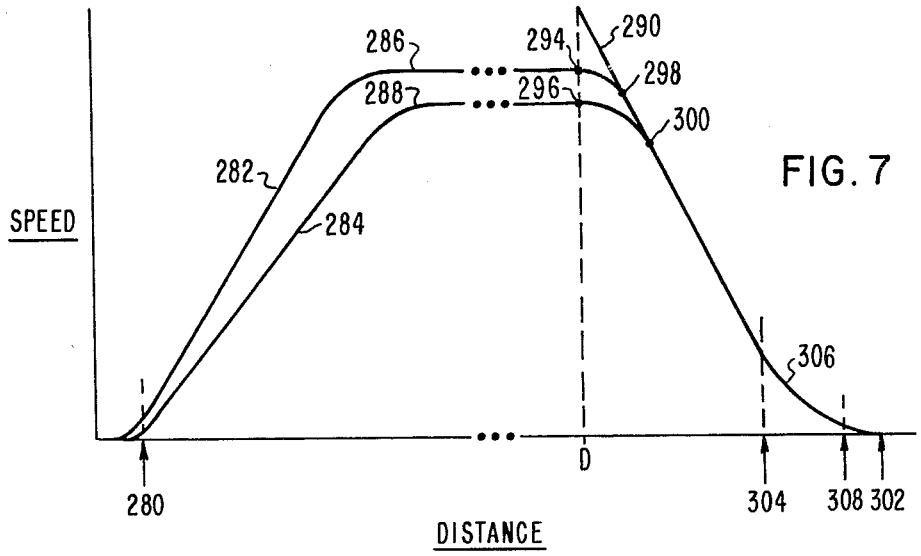
FIG. 7 is a graph which illustrates car speed versus distance for a run in which feedback control is used only for the deceleration portion of the run.

The pulse wheel plus the technique of FIG. 5 for obtaining a substantially ripple-free analog signal in response to the actual speed of the elevator car may be used in a feedback arrangement throughout a complete run; or only during the deceleration phase of a run, which is the preferred embodiment of the invention; or at selected phases of the run. For example, FIG. 7 is a graph which illustrates elevator car speed versus distance for a run according to the preferred embodiment of the invention, wherein speed feedback is used only on the deceleration phase. The elevator car accelerates away from the floor under open-loop starting ramp control up to point 280, and then continues to accelerate along a natural acceleration curve dependent upon the load condition, such as curve portion 282 for an overhauling load, and curve portion 284 for a hauling load. The speed-torque characteristic of the AC induction motor provides a smooth transition from maximum acceleration to zero acceleration and maximum speed, with the maximum speed being determined by the type of load, such as curve portion 286 for an overhauling load and curve portion 288 for a hauling load.

When the floor selector 96 identifies that the next floor at which the elevator car can make a normal stop according to a predetermined deceleration schedule is a floor at which the car should stop, selector switch or contact 140 in FIG. 2 closes, and the next distance cam or indicator which the car passes in the hoistway indicates the distance point D to the stopping floor has been reached. The D point for the stopping floor activates the feedback control and starts the deceleration phase of the run. The deceleration speed pattern 290 starts at point D, at a magnitude which represents a speed greater than the maximum possible car speed. This, along with a new and improved anticipation feature, enables a single speed pattern signal 290 to be used regardless of the speed of the elevator car at the time slowdown phase is be initiated. The anticipation feature functions even when the elevator car is still accelerating as it approaches the speed profile of the speed pattern signal 290. The anticipation feature, shown in block form at 292 in FIG. 1, and which will be hereinafter explained in detail, starts at distance D, and thus the DC dynamic braking is initiated before the actual car speed pattern. The magnitude of the DC braking torque is determined by car velocity and acceleration. For example, from curve portion 286, DC braking would start at distance D, i.e., point 294, and from the lower speed curve portion 288 it would also start at distance D, i.e., at point 296, but the braking torques would be different. Thus, the actual car speed is caused to blend smoothly into the speed pattern 290 without overshoot or uncomfortable jerk, with the curve portion between point 294 and the intersection 298, and the curve portion between point 296 and the intersection 300 being formed by simultaneous motoring and braking torques, as both the high and low speed components are energized during this time. At the intersection of the actual car speed with the speed pattern, i.e., point 298 or point 300, the anticipatory function is terminated, and the AC contactor 50 is dropped to discontinue the motoring torque. The actual car speed is then caused to follow the speed pattern by controlling the magnitude of the DC voltage applied to the low speed component 46. If the inertia of the elevator system is not sufficient to carry the elevator car to the stopping floor under the worst load and travel direction conditions, the flywheel 86 shown in phantom in FIG. 1 is added to supply the required additional inertia for the specific elevator system.

Returning to FIG. 7, when the elevator car reaches a predetermined point from the floor position 302, such as 14 to 16 inches, indicated at 304, the pattern begins a flare 306 to bring the elevator car to a smooth stop at floor level 302 without uncomfortable jerk. At a predetermined shorter landing distance 308 from the floor position 302, such as 0.25 or 0.5 inch, a time delay function is initiated, at the end of which a signal is provided to set the electromechanical brake 40. This time delay function, illustrated at 309 in FIG. 1, which may be a MONO or one-shot, is selected such that the brake 40 is set after the car stops at floor level, to prevent the brake action from being felt in the elevator car. At the same short landing distance 308, the stopping ramp function is initiated, with this function being shown in block form at 310 in FIG. 1. The stopping ramp function ramps the braking DC voltage upwardly, open loop, to overcome the natural reduction in DC dynamic braking torque at very low motor speeds. This stopping ramp is initiated and valued to stop the elevator car at floor level. The time delay and the stopping ramp function will be described in detail hereinafter.

Figure 8:
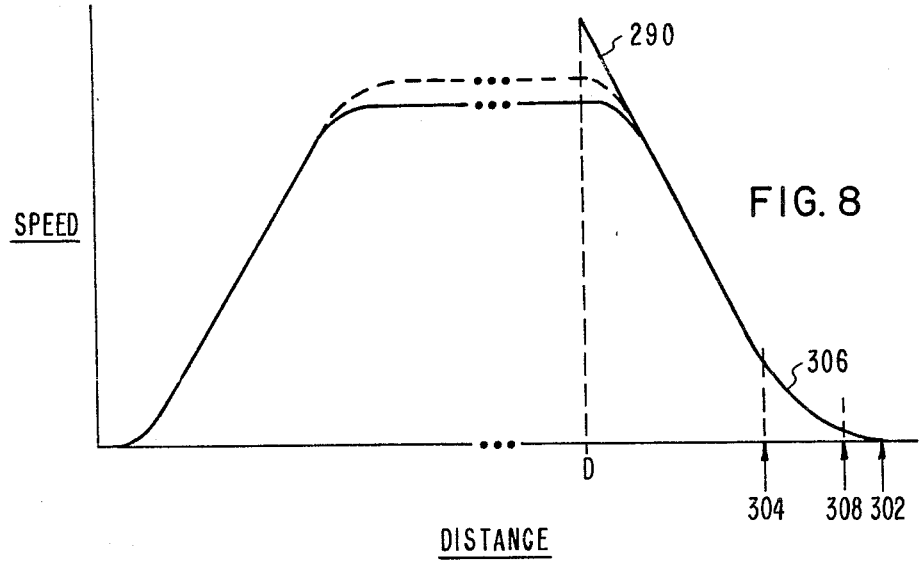
FIG. 8 is a graph which illustrates a car speed versus distance curve for a run which uses feedback control on the complete run, and also a curve for a run with feedback control only during acceleration and deceleration.

An alternative control arrangement is illustrated in FIG. 8, which is a graph which plots car speed versus distance to the floor. In this graph, the solid curve indicates feedback control throughout the run, while the broken curve portion indicates that feedback is used only on the acceleration and deceleration phases of a run. With feedback control during the acceleration phase, an open loop starting ramp may still be used to prevent an initial bump from being felt in the car as the feedback loop gains control. Alternatively, the speed pattern itself may be structured to provide the required high initial DC braking torque to provide a smooth, bumpless start. The anticipation feature may also be used in order to smoothly blend a time based acceleration speed pattern with a distance based deceleration speed pattern.

In either of the arrangements shown in FIGS. 7 and 8, instead of disconnecting the AC motoring torque at the coincidence of the speed pattern and actual speed signals, it has been found that the fixed AC may be connected to the high speed component throughout the complete run. The DC braking on the low speed component is sufficient to completely overcome the motoring torque. This has the advantage of providing the torque necessary to bring the elevator car to floor level under any load and travel direction conditions, eliminating the need for the flywheel 86.

Figure 9:
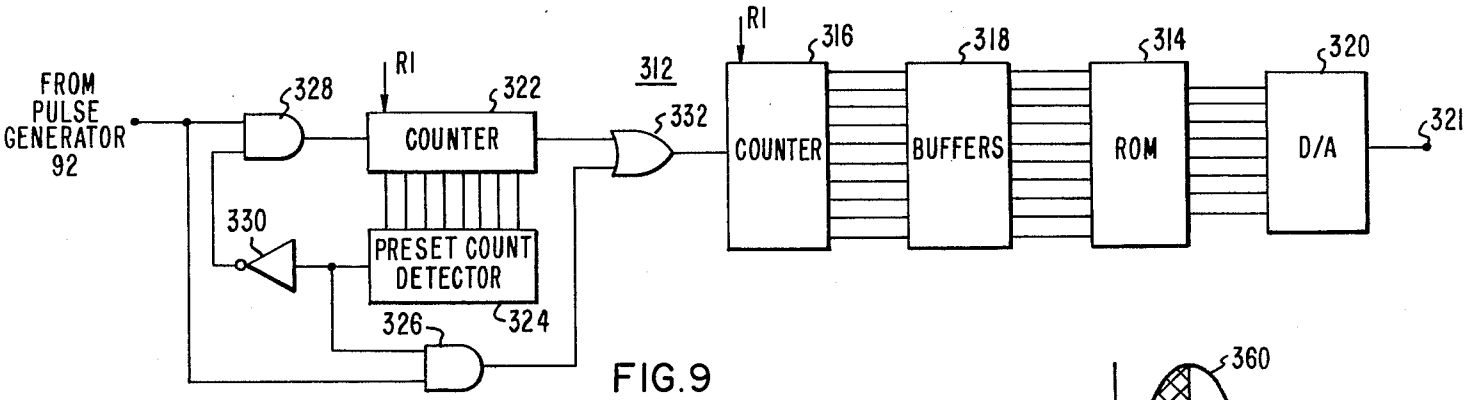
FIG. 9 is a schematic diagram of a circuit which may be used for the deceleration speed pattern generator shown in block form in FIG. 1.

The deceleration phase of a run is controlled by a deceleration speed pattern generator 312 shown in block form in FIG. 1, and in detail in FIG. 9. As disclosed in U.S. Pat. Nos. 4,102,436 and 4,046,229, both of which are assigned to the same assignee as the present application, a distance based speed pattern generator is conveniently formed by a read-only memory (ROM). The present invention utilizes a ROM, and minimizes the amount of ROM memory required by a new and improved divider arrangement which utilizes all of the distance pulses to clock the ROM in the flare 306 shown in FIGS. 7 and 8, and only a predetermined fraction of the distance pulses from point D to just before the start of the flare.

More specifically, referring to FIG. 9, the deceleration speed pattern generator 312 includes a ROM 314 addressed by a counter 316 via buffers 318. A digital-to-analog (D/A) converter 320 provides an analog signal at output terminal 321 responsive to the ROM output. The ROM is programmed to output a digital number responsive to the desired speed at each incremental location of the elevator car between point D and the stopping floor.

A distance pulse from the pulse wheel is provided for each small increment of car travel, such as 0.02 inch. If each distance pulse were to address the ROM 314, a very large ROM memory capacity would be required, and the actual output of the ROM would change very little from increment to increment over most of the deceleration phase. For example, the ROM output may stay the same for fifty or sixty consecutive distance pulses, requiring the same digital values to be stored at different successive memory locations of the ROM. However, when the flare is reached, the speed changes more rapidly, and each distance pulse would be required in order to provide a smoothly changing analog speed pattern. The present invention solves this problem by an arrangement which utilizes an auxiliary counter 322, a pre-set count detector 324, AND gates 326 and 328, an inverter 330, and an OR gate 332. The distance pulses are applied to an input of each of the AND gates 328 and 326. The pre-set count detector is connected to be responsive to the count on counter 322. It outputs a logic zero when the count is below the preset count, and a logic one when the pre-set count is reached. The output of count detector 324 is applied directly to an input of AND gate 326, and to an input of AND gate 328 via inverter 330. The output of AND gate 328 is applied to the clock input of counter 322, and the output of AND gate 326 is applied to an input of OR gate 332. The other input to OR gate 332 is connected to a selected output line of counter 322, with the specific output selected being determined by the number of distance pulses which are to be used to address ROM 314 prior to the flare. The pre-set count on detector 324 is set to that count which indicates the desired number of distance pulses from point D to just before the start of the flare. The output of OR gate 332 is connected to the clock input of counter 316. Thus, the output of detector 324 initially enables AND gate 328 and disables AND gate 326. Thus, the count appearing at the selected output of counter 322 is counted by counter 316. For example, output #7 of RCA's counter CD 4020 will provide a clocking pulse for counter 316 for each sixteen distance pulses, and the ROM 314 would be programmed to provide the desired speed at distance increments of $16 \times 0.02''$ (0.32 inch). When the pre-set count is reached, ANd gate 328 is disabled, and AND gate 326 is enabled, and all of the distance pulses are applied to the counter 316. The ROM 314 is programmed for these count values to provide the desired speed at distance increments of 0.02 inch.

Output terminal 321 of the D/A converter 321 is connected to one input of differential amplifier 244 via an analog switch 334 shown in FIG. 1. Analog switch 334 is controlled by output $\overline{RL}$ from the floor selector 96. Signal $\overline{RL}$ maintains switch 334 conductive until a releveling command is given, at which time $\overline{RL}$ goes low to ender switch 334 non-conductive. Signal $\overline{RL}$ is also used to enable a leveling speed pattern to be substituted, as will be hereinafter explained.

Figure 10:
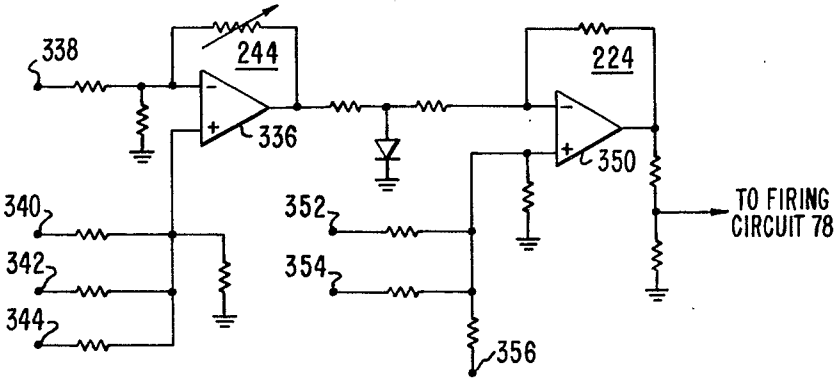
FIG. 10 is a schematic diagram of a circuit which may be used for differential amplifier and summing amplifier functions shown in block form in FIG. 1.

FIG. 10 illustrates a differential amplifier 244 and summing amplifier 224 which may be used for these functions shown in block form in FIG. 1. Differential amplifier 244 includes an OP amp 336 having its inverting input connected to receive the sample and hold signal via analog switch 252 (i.e., the actual car speed). The non-inverting input is connected to receive the various speed patterns utilized. For example, it is connected to an input terminal 340 which receives the output of the D/A converter 320 of the deceleration speed pattern generator 312 via the analog switch 334. If an acceleration speed pattern generator is used, such as shown in block form at 242 in FIG. 1, it would be connected to an input terminal 342 via the analog switch 246. The non-inverting input of OP amp 336 is also connected to an input terminal 344 for receiving the releveling speed pattern, such as from function 346 via an analog switch 348 shown in FIG. 1. The differential amplifier determines which of its inputs is larger, and the magnitude of the difference, and it applies its output to the summing amplifier 224.

Summing amplifier 224 includes an OP amp 350 which has its inverting input connected to receive the output or error signal from differential amplifier 244. The non-inverting input of OP amp 350 is connected to an input terminal 352 which is connected to receive a signal from the stopping ramp function 310 shown in FIG. 1. The non-inverting input is also connected to an input terminal 354 from the anticipation control function 292 via the analog switch 358 shown in FIG. 1. The non-inverting input is also connected to an input terminal 356 from the starting ramp function 222 shown in FIG. 2. The output of the summing amplifier 224 is the error signal, as modified by the various inputs to the non-inverting channel of the summing amplifier 224. The modified error signal is applied to the power controller or firing circuit 78.

Figure 11:
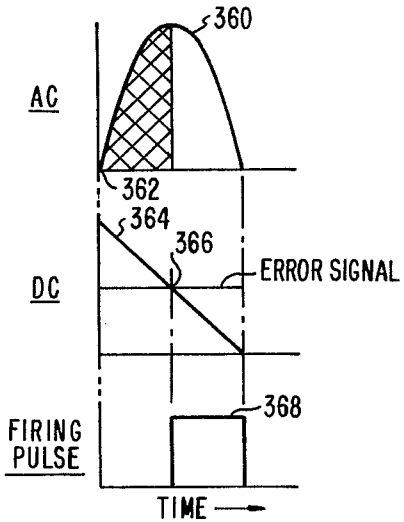
FIG. 11 is a graph which illustrates how the error signal from the summing amplifier shown in FIG. 1 may be used to provide firing pulses for the thyristors in the controllable DC bridge.

FIG. 11 is a graph which functionally illustrates how the modified error signal may be used to generate reliable firing pulses for the thyristors 70 and 72 of the bridge circuit 54 shown in FIG. 1. Curve 360 illustrates a positive half cycle of the AC source 62. At the zero crossing 362, a DC ramp 364 is initiated which is ramped linearly downward with time. The value of the ramp is compared with the value of the modified error signal from the summing amplifier 224, such as in an OP amp comparator. When the error signal exceeds the falling ramp signal at point 366, a firing pulse 368 is provided for thyristor 70. The unshaded portion of half-cycle 360 illustrates the portion thereof which is applied to the low speed component. In like manner, the negative half cycle provides a firing pulse for the other thyristor.

Figure 12:
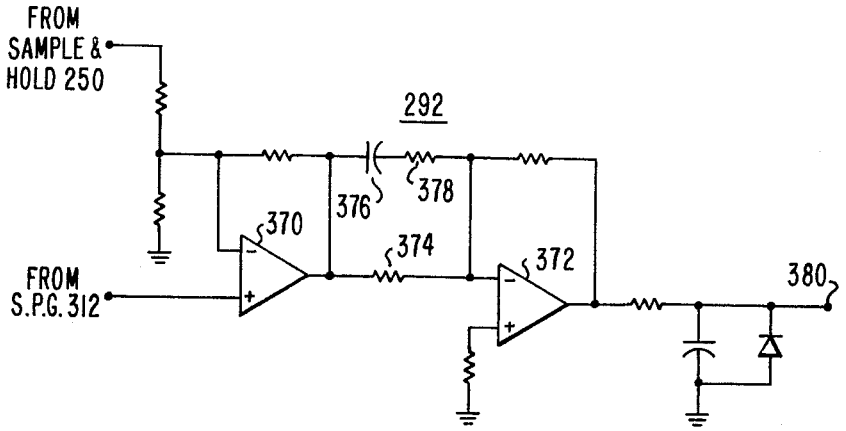
FIG. 12 is a schematic diagram of a circuit which may be used for the anticipation function shown in block form in FIG. 1.

The anticipation function 292 shown in FIG. 1 may be performed by the circuit shown in FIG. 12. The anticipation function 292 takes into account the speed of the elevator car, and the acceleration of the elevator car, as it approaches the speed pattern or desired speed, to initiate DC dynamic braking of the low speed component before the actual speed of the elevator car intersects the speed pattern signal. Thus, smooth blending of the actual speed with the desired speed is achieved without uncomfortable jerk in the car, and without pattern overshoot. This is accomplished by introducing an adjustment factor into the feedbck loop responsive to the difference between the actual car speed and the pattern speed, plus a factor responsive to the derivative of this difference. It has been found that the optimum torque adjustment is given by the following relationship:

$$T = K\left[(V_a - V_{sp}) + 2\frac{d(V_a - V_{sp})}{dt}\right]$$

where $V_a$ is equal to the actual car speed and $V_{sp}$ is equal to the desired car speed. A differential amplifier, such as OP amp 370 has its inverting input connected to receive a signal responsive to actual car speed, i.e., to the output of the sample and hold circuit 250, and it has its non-inverting input connected to receive the pattern signal, i.e., the output from the D/A 320 in the deceleration speed pattern generator 312. Its output provides the required difference signal between these two values. This difference is added to twice the derivative of this difference in a summing amplifier, such as OP amp 372. The difference is applied to the inverting input of OP amp 372 via the branch which includes resistor 374. The derivative of the difference is applied to the inverting input via the branch which includes capacitor 376 and resistor 378. The doubling factor is provided by the ratio of the resistor in the feedback loop to the ratio of the resistor 378. The output appearing at terminal 380 is thus the sum of the difference and twice the derivative or rate of change of the difference. This signal is applied to input terminal 354 of the summing amplifier 224 shown in FIG. 10 via analog switch 358 shown in FIG. 1. Analog switch 358 is controlled by a comparator function 382, an inverter 384, and an AND gate 386, all shown in FIG. 1. Comparator function 382 normally outputs a logic one, switching to a logic zero when the speed pattern and actual car speed coincide, as determined by "zero error" at the output of differential amplifier 244. The output of comparator 382 is connected to one input of AND gate 386, and to an input of OR gate 388 shown in FIG. 2. The other input of AND gate 386 is connected to receive signal $\bar{R}$ via inverter 384. Signal $\bar{R}$ goes low at point D to cause AND gate 386 to output a logic one to thus turn on analog switch 358 and render the anticipation control function 292 effective. When coincidence between the actual speed and the speed pattern occurs, as detected by detector 382, AND gate 386 renders analog switch 358 non-conductive, to discontinue the anticipation control.

The other input to OR gate 388 shown in FIG. 2 is connected to receive signal $\bar{R}$, which is a logic one until the D point is reached by the elevator car relative to the stopping floor. The output of OR gate 388 is connected to reset the motor flip-flop 212 and disconnect the AC line voltage from the high speed component at the coincidence of the actual speed with the desired speed. Of course, this feature would only be used in the preferred embodiment wherein the deceleration phase is controlled only by the DC braking torque. If it is desired that the AC high speed component continue to provide motoring torque during the deceleration phase, the AC line voltage would not be disconnected from the high speed component at this time.

Figure 13:
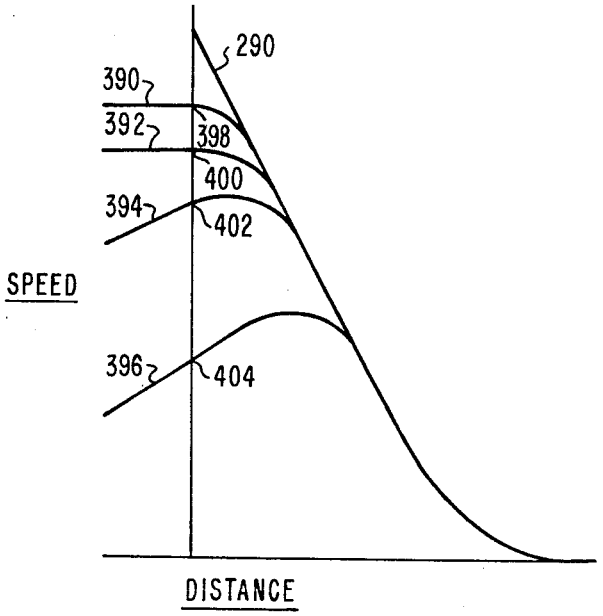
FIG. 13 is a graph which illustrates the effect of the anticipation circuit shown in FIG. 11.

FIG. 13 is a graph which illustrates the speed pattern 290 being approached by different constant car speeds in curved portions 390 and 392, and by different accelerating car speeds in curves 394 and 396. The point where DC dynamic braking is initiated is shown at points 398, 400, 402 and 404, respectively.

When the elevator car 22 reaches a predetermined distance from the floor at which the flare starts in the deceleration speed pattern, the distance increment which addresses ROM 314 is changed, as hereinbefore described, to create an accurate, smooth pattern change during the flare.

At a predetermined shorter distance from the floor, such as 0.25 or 0.5 inch, the stopping ramp function 310 and the time delay function 309 are initiated. As illustrated in FIG. 1, this distance is determined from the output of the deceleration speed pattern generator 312 by a comparator 406, which includes an OP amp 407. When the predetermined distance from the floor is reached, selected by the reference voltage applied to the noninverting input of OP amp 407, the output of comparator 406 changes from negative to positive.

Figure 14:
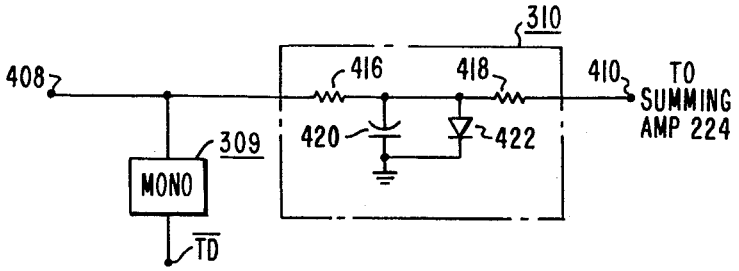
FIG. 14 is a schematic diagram of a circuit which may be used for the time delay and stopping ramp functions shown in block form in FIG. 1.

FIG. 14 illustrates time delay 309, and also a circuit which may be used for the stopping ramp function 310, shown in block form in FIG. 1. Input terminal 408 is connected to receive the output of comparator 406. When the output of comparator 406 is negative, signal $\overline{TD}$ provided by time delay 309 is a logic one. When the comparator output switches positive, signal $\overline{TD}$ goes to logic zero after a predetermined time delay, to set the brake a predetermined short period of time after the output of the comparator 406 switches polarity.

The output of comparator 406 is also applied to the stopping ramp 310 shown in FIG. 14. The stopping ramp 310 includes resistors 416 and 418, a capacitor 420, and a diode 422. When the output of comparator 406 switches polarity at the predetermined distance from the floor, capacitor 420 discharges from its negative value towards ground. Thus, the output of the summing amplifier and the error signal applied to the firing circuit 78 are caused to increase linearly to increase the braking torque.

Figure 15:
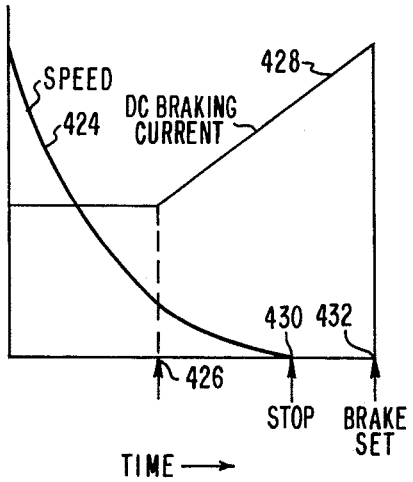
FIG. 15 is a graph which illustrates the operation of the time delay and stopping ramp functions shown in FIG. 14.

FIG. 15 is a graph which illustrates the operation of the stopping ramp and time delay circuits. As the elevator car 22 approaches floor level, its speed is decreasing with time along a curve 424. When the elevator car reaches the predetermined distance from the floor signified by comparator 406 changing polarity, indicated at time 426, the DC braking current is ramped upwardly along curve 428. The elevator car stops at floor level at time 430, and the electromechanical brake sets a short time later at time 432.

OR gates 164 and 166 and AND gate 168 insure that brake 40 is applied when the last leveling switch closes to signify the car is at floor level. They provide a backup, if for some reason signal $\overline{TD}$ does not go low to set the brake. If the car is moving downwardly into floor level, OR gate 164 outputs a logic one, and AND gate 168 outputs a logic one until switch 112 closes and the output of OR gate 166 goes to zero. When the output of AND gate 168 goes to zero, it triggers the brake flip-flop 154 via a pulse from capacitor 171 which functions as a differentiator. If the car is moving upwardly into floor level, OR gate 166 outputs a logic one and AND gate 168 outputs a logic one until switch 114 closes and the output of OR gate 164 goes to zero.

Should stretch of rope releveling be required due to an increase in the load of the elevator car, the elevator car will move downwardly and leveling switch 114 will open, indicating that up releveling is required. Referring now to FIG. 2, first note that when the mechanical brake 40 is picked up, the relevel circuitry is deactivated since the input to OR gate 198 from NAND gate 156 is high. Thus, the output of OR gate 198 is high, forcing the output of NOR gate 192 low, blocking AND gate 200. Thus, AND gate 200 applies a logic zero to an input of NOR gate 196. Also note that the input to NOR gate 194 is low, applying a high input to AND gate 202. Since NOR gate 196 already has a low input from AND gate 200, the direction relay 210 is solely controlled by the direction switch 122, i.e., gates 202 and 196 are enabled.

The relevel circuitry becomes active only when the brake 40 is applied. When brake 40 is applied, the output of NAND gate 156 is low, applying a low input to OR gate 198. Signal $\overline{R}$ is also low, and thus the other input to OR gate 198 is low. In this situation, releveling is called for whenever either switch 112 or switch 114 opens. If the elevator car moves above floor level, such as when load leaves the car and the stretched cables shrink, switch 112 will open applying a logic one to NOR gate 190, and NOR gate 190 applies a logic zero to NOR gate 192. The output of NOR gate 192 goes high which starts the AC drive machine via OR gate 218.

AND gate 200 also has a high input from open switch 112, and a high input from NOR gate 192. AND gate 200 thus applies a logic one to NOR gate 196, which applies a logic zero to transistor 208 to select the down contactor 52.

Since the input to NOR gate 194 is high, its output will be low, blocking signals from the direction switch 122. Direction is thus solely under control of the lower input of NOR gate 196. When the elevator car moves downwardly to floor level, switch 112 will close and the output of NOR gate 192 will go low to disconnect the AC from the drive machine.

If the elevator car moves downwardly from floor level, instead of upwardly, such as due to rope switch when load enters the elevator car, switch 114 will open and apply a logic one to NOR gate 190. Thus, the output of NOR gate 192 goes high, starting the AC drive machine via OR gate 218. The input to AND gate 200 from switch 112, however, is low. Since NOR gate 196 has two low inputs its output is high, turning on transistor 208 to select the up contactor 50, which causes releveling in the up direction. When the elevator car is again at floor level, switch 114 will close and the output of NOR gate 192 will go low to disconnect the AC from the drive machine.

The time delay circuit 204 in the line from NAND gate 156 to NOR gate 198 is important. It includes resistors 253 and 255 serially connected in the line, a capacitor 257 connected from their junction to ground, and a diode 259 connected across resistor 255. Diode 259 has its anode connected to the output of NAND gate 156. When the car is landing and brake flip-flop 154 is triggered to cause the output of NAND gate 156 to go low, time delay 204 has a long-time delay to prevent the releveling portion of the control from becoming active in the event both switches 112 and 114 are not yet closed. Thus, the enabling signal for releveling is delayed by time delay 204. On the other hand, the disabling signal for releveling, i.e., the output of NAND gate 156 going high, is not delayed, as for positive going signals diode 259 provides a low impedance path around resistor 255. Thus, the time delay is very short in order to prevent the relevel circuitry from "fighting" the start of the car away from the floor in response to a start command which picks up the brake.

It should be noted that when NOR gate 192 applies a logic one to an input of OR gate 218 to apply AC line voltage to the high speed component 44, that it also activates the starting ramp function 222, causing the firing circuit 78 to apply a large error signal to bridge 54, which signal is ramped downwardly with time. Thus, the starting for releveling is smooth, as described relative to the start of the car for a run. Leveling through the brake makes it unnecessary to ramp the DC braking current upwardly to stop the car, as in the normal stop.

The logic one signal from NOR gate 192, when releveling is called for, is inverted by inverter 299 in FIG. 1 to disable analog switch 334. Thus, the deceleration speed pattern generaor 312 is disconnected from the differential amplifier 244. The logic one output from NOR gate 192, signal RL, turns on analog switch 348 shown in FIG. 1 to activate the releveling speed function 346, and it is inverted by inverter 313 to turn off analog switch 252. The releveling speed function 346 applies a fixed bias to differential amplifier 244, the magnitude of which is selected to represent the desired releveling speed. When the open switch 112, or 114, again closes at floor level, the leveling speed pattern 346 is disconnected from the differential amplifier 244 to drop the speed error to zero and terminate the DC applied to the low speed component. The output of OR gate 218 drops to zero, to disconnect the AC line voltage from the high speed component. The electromechanical brake 40, which is set during releveling, then stops the car at floor level.

Figure 16:
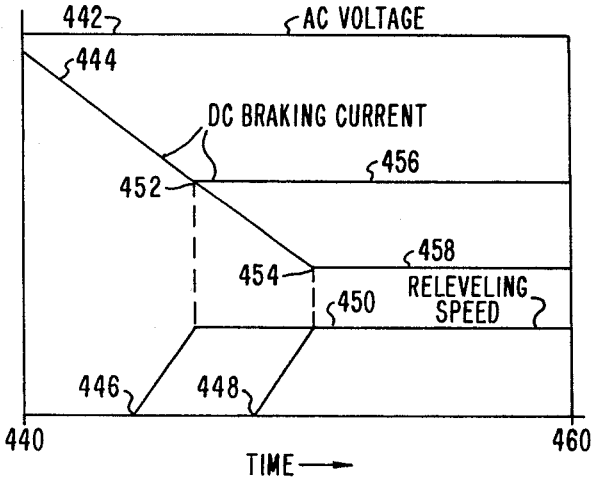
FIG. 16 is a graph which illustrates the releveling function shown in FIG. 15.

FIG. 16 is a graph which illustrates the releveling function. When releveling is initiated at 440, AC voltage 442 is applied to the high speed component and the DC starting ramp 444 is activated. Depending upon whether the car load is overhauling or hauling, the car starts moving at 446 or 448, respectively, and the car speed increases to the releveling speed 450. The DC braking ramp terminates at 452, or 454, for overhauling and hauling loads, respectively, and remains constant at 456 or 458, respectively, until floor level is reached, indicated at time 460. The AC and DC are both terminated at this time, and the brake 40 stops the car.

In summary, there has been disclosed a new and improved elevator system in which the motoring torque is provided by a fixed, i.e., non-controlled AC line voltage applied to the high speed component of a two-speed AC drive system. Torque control is provided by a controllable direct current voltage applied to the low speed component of the drive system. The direct current braking torque control plus the system braking torque, which is high at low car speeds due to the reduction gear, completely offset the torque produced by the high speed component upon start-up and releveling, and the DC voltage is then ramped downwardly with time to achieve a smooth initial car movement.

In a preferred embodiment, no speed feedback control is provided, or required, until the deceleration phase of the run. A single speed pattern is provided for the deceleration phase from a ROM, regardless of the length of the run or the speed and acceleration of the car as the deceleration phase is initiated. This desirable arrangement is achieved without pattern overshoot or a bump in the car, by a new and improved pulse wheel/sample and hold arrangement which improves speed response while substantially eliminating ripple from the pulse wheel speed feedback system, and by a new and improved anticipation control which anticipates the intersection of the actual car speed with the deceleration speed pattern. The deceleration speed pattern starts at a magnitude which represents a speed which is greater than the maximum possible speed of the elevator car, and the difference between the pattern and the actual car speed is compared. This difference, plus the rate of change of the difference, is used to provide a signal which starts DC dynamic braking before actual intersection of the actual car speed with the speed pattern, enabling a smooth blending of the car speed with the speed pattern. Actual intersection of the car speed with the speed pattern terminates the motoring torque, and the elevator car is brought to a stop at floor level by controlled DC dynamic braking on the low speed component.

ROM capacity in the deceleration speed pattern is minimized by a new and improved speed pattern generator arrangement which utilizes a predetermined fraction of the distance pulses to address the ROM until the flare portion of the speed pattern is reached, at which point all of the distance pulses are applied to clock the counter which, in turn, addresses the ROM.

The final stop of the elevator car is achieved without the use of the electromechanical brake, notwithstanding the reduction in DC braking torque at low speed, by detecting the arrival of the car at a predetermined short distance from floor level, and then initiating an upward ramp in the DC braking voltage and current.

Releveling, if necessary, such as due to rope stretch or rope contraction, is initiated without lifting the electromechanical brake. Initial movement of the car is achieved in the same manner as the initial movement at the start of a run, by simultaneous application of AC and DC to the high and low speed components, and ramping the DC downwardly with time, which produces a resultant torque which starts at zero and increases smoothly to accelerate the car to a leveling speed. Since the brake is not lifted during releveling, when the elevator car reaches floor level the motoring and braking torques are simply terminated, enabling the electromechanical brake to stop the car at the floor level.

In other embodiments of the invention, in addition to speed feedback control during the deceleration phase, the speed feedback control is used in other phases of the run, such as during the acceleration phase, or during the acceleration and constant speed phases. In still another embodiment, the AC line voltage is not disconnected from the high speed component at the intersection of the actual and desired speeds, allowing both motoring and braking control of the elevator car right into the floor.

While the invention has been described relative to a geared elevator system, certain aspects of the invention may be used in a gearless system, and the invention should thus not be restricted to geared elevator systems.

We claim as our invention:

1. An elevator drive system for selectively providing motoring and system braking torques which control the starting, driving, and stopping of an elevator car during a run, comprising:

an elevator car, alternating current motor means disposed to effect movement of said elevator car, said alternating current motor means including electrically isolated high and low speed components, first control means for applying a non-adjustable alternating current line voltage to said high speed component, to develop a motoring torque, second control means for applying a controllable direct current voltage to said low speed component, with said controllable direct current voltage being capable of developing a braking torque in the low speed component which provides a system braking torque sufficient to stop said elevator car when moving, and to prevent said elevator car from moving when stationary, notwithstanding the simultaneous application of the alternating current line voltage to said high speed component, and third control means for controlling said first and second control means such that the high and low speed components simultaneously develop motoring and braking torques during at least a selected portion of a run, with the system braking torque exceeding the motoring torque at least once during said selected portion of a run.

2. The elevator drive system of claim 1 wherein the alternating current motor means includes an output shaft, a drive sheave, and gear means coupling said output shaft to said drive sheave, with said gear means inherently providing a braking torque which is part of the system braking torque.

3. The elevator drive system of claim 1 wherein the second control means includes ramp means for providing a direct current ramp voltage for the low speed component which starts at a predetermined initial magnitude selected such that the system braking torque exceeds the motoring torque of the high speed component, said ramp voltage being reduced with time to reduce the system braking torque below the magnitude of the motoring torque, with the third control means simultaneously activating the first control means and said ramp means to cause smooth initial movement of the elevator car.

4. The elevator drive system of claim 3 wherein the third means activates the first control means and the ramp means of the second control means at the start of a run.

5. The elevator drive system of claim 4 wherein the ramp means reduces the direct current voltage to zero with time.

6. The elevator drive system of claim 4 including pattern means providing a speed pattern signal, said speed pattern signal being indicative of the desired speed of the elevator car, at least during an acceleration portion of the run, tachometer means providing a tach signal responsive to the actual speed of the elevator car, and comparator means providing a difference signal responsive to the difference between the speed pattern signal and the tach signal, and wherein the second control means controls the direct current voltage applied to the low speed component in response to said difference signal.

7. The elevator drive system of claim 3 including leveling means providing a releveling signal indicative that releveling of the elevator car is necessary, and wherein the third means activates the first control means and the ramp means of the second control means in response to said releveling signal.

8. The elevator drive system of claim 3 including an electromechanical brake which is set at the end of a run, and including leveling means providing at releveling signal indicative of releveling of the elevator car as necessary, and wherein the third means activates the first control means and the ramp means of the second control means in response to said releveling signal, with said releveling being accomplished with said electromechanical brake set.

9. The elevator drive system of claim 8 including means providing a leveling speed signal when a predetermined leveling speed is reached, and means responsive to said leveling speed signal for controlling the direct current voltage applied to the low speed component, and wherein the leveling means provides a predetermined position signal when the elevator car is at a predetermined position, with said first control means being responsive to said position signal to remove the alternating current line voltage from the high speed component and the direct current voltage from the low speed component.

10. The elevator drive system of claim 1 including pattern means providing a speed pattern signal indicative of the desired speed of the elevator car, at least during a predetermined portion of a run, tachometer means providing a speed signal responsive to the actual speed of the elevator car, and comparator means providing a difference signal responsive to the difference between the speed pattern and actual speed signals, with the second means being responsive to said difference signal such that the direct current voltage applied to the low speed component results in a system braking torque which opposes the motoring torque to provide a resultant torque which controls the actual speed of the elevator car to follow the desired speed indicated by the speed pattern signal.

11. The elevator drive system of claim 10 wherein the pattern means provides a speed pattern signal for a complete run.

12. The elevator drive system of claim 10 wherein the pattern means provides a speed pattern signal only during the slowdown portion of a run.

13. The elevator drive system of claim 10 wherein the pattern means provides a time-based speed pattern signal during the acceleration portion of a run, and a distance-based speed pattern signal during the deceleration portion of a run.

14. The elevator drive system of claim 1 including speed pattern means providing a single speed pattern signal when the elevator car reaches a predetermined distance from the desired stopping point, with said speed pattern signal being indicative of the desired deceleration of the elevator car, with the initial magnitude of the speed pattern signal corresponding to a car speed which exceeds the maximum possible speed of the elevator car, tachometer means providing an actual speed signal, comparator means providing a difference signal responsive to the difference between said speed pattern signal and said actual speed signal, and anticipation means which provides an anticipation signal in response to the speed pattern and actual speed signals, with said second control means initiating a braking torque in the low speed component in response to said anticipation signal.

15. The elevator drive system of claim 14 wherein the anticipation signal is responsive to the difference between the speed pattern and actual speed signals, plus the derivative of the difference.

16. The elevator drive system of claim 14 including means providing a coincidence signal when the actual speed signal and speed pattern signal are equal, with said first control means disconnecting the alternating current line voltage from the high speed component in response to said coincidence signal.

17. The elevator drive system of claim 16 including a flywheel disposed to add sufficient inertia to the alternating current motor means to ensure that the elevator car will reach the desired stopping point.

18. The elevator system of claim 14 including means providing a landing signal when the elevator car is a predetermined distance from the desired stopping point, and wherein the second means includes ramp means responsive to said landing signal which increases the direct current above that called for by the difference signal, to stop the elevator car at the desired stopping point.

19. The elevator system of claim 14 including leveling means providing a releveling signal indicative that releveling of the elevator car is necessary, and wherein the third means activates the first and second control means such that the system braking torque initially exceeds the motoring torque, with the braking torque of the second control means being ramped downwardly to a value less than the motoring torque to start the releveling of the elevator car.

20. The elevator system of claim 19 including means providing a leveling speed signal when a predetermined leveling speed is reached, and means terminating the ramping of the braking torque to maintain a resultant torque which provides said leveling speed, and wherein the leveling means provides a predetermined position signal when the elevator car is at a predetermined location, with the first and second means being responsive to said predetermined position signal to terminate the motoring and braking torques, respectively.

21. The elevator drive system of claim 1 including a feedback arrangement comprising pattern generator means providing a pattern signal indicative of the desired speed of the elevator car for at least a portion of the run, tachometer means providing a tach signal responsive to the actual speed of the elevator car, and comparator means providing a difference signal responsive to the difference between said pattern signal and said tach signal, with said second control means controlling the magnitude of the direct current applied to the low speed component in response to said difference signal.

22. The elevator system of claim 21 wherein the tachometer means includes shaft encoder means providing a first train of pulses, with each pulse being provided in response to a predetermined increment of elevator car movement, pulse means providing a second train of pulses in response to the first train of pulses, with the pulses of the second train having a constant width, integrator means integrating said second train of pulses, timing means providing a timing signal in response to said first train of pulses, and sample and hold means, said sample and hold means sampling the output of said integrator means in response to said timing signal to provide an output signal responsive to the magnitude of the output of said integrator means at the time said timing signal is provided.

23. The elevator drive system of claim 21 wherein the pattern generator means includes a read-only memory having a speed pattern stored therein, and addressing means for addressing the read-only memory in response to movement of the elevator car, when the elevator car reaches a predetermined first distance from the desired stopping point, with the car movement increment which changes the address applied to the read-only memory being relatively large until the elevator car reaches a predetermined second distance from the desired stopping point, at which point the car movement increment which changes the address applied to the read-only memory is substantially reduced.

24. The elevator drive system of claim 23 wherein the tachometer means provides a pulse for each predetermined increment of car travel, and wherein the addressing means includes a first counter which addresses the read-only memory, and a second counter which counts the pulses provided by the tachometer means, with the first counter being clocked by a predetermined output of the second counter, until the predetermined second distance is reached, and then by the tachometer pulses.

25. The elevator drive system of claim 24 wherein the count on the second counter indicates when the second predetermined distance is reached.

26. An elevator system comprising:

an elevator car, drive means for said elevator car including first means for providing a motoring torque and second means for providing a braking torque, speed pattern means providing a single speed pattern signal when the elevator car reaches a predetermined distance from the desired stopping point, with said speed pattern signal being indicative of the desired deceleration of the elevator car, and with the initial magnitude of the speed pattern signal corresponding to a car speed which exceeds the maximum possible speed of the elevator car, tachometer means providing an actual speed signal, comparator means providing a difference signal responsive to the difference between said speed pattern signal and said actual speed signal, and anticipation means which provides an anticipation signal responsive to the speed pattern and actual speed signals with said second means initiating a braking torque which opposes the motoring torque provided by the first means, in response to said anticipation signal.

27. The elevator drive system of claim 26 wherein the anticipation signal is responsive to the difference between the speed pattern and actual speed signals, plus a factor responsive to the derivative of the difference.

28. The elevator drive system of claim 26 including means providing a coincidence signal when the actual speed signal and the speed pattern signal are equal, with said first and second means discontinuing the motoring and anticipatory braking torques, respectively, in response to said coincidence signal.

29. The elevator drive system of claim 28 including a flywheel disposed to add sufficient inertia to the drive means to ensure that the elevator car will reach the desired stopping point.

30. An elevator system, comprising:

an elevator car, drive means for said elevator car, pattern generator means providing a deceleration pattern signal indicative of the desired speed of the elevator car, tachometer means providing a tach signal responsive to the actual speed of the elevator car, comparator means providing a difference signal responsive to the difference between said pattern signal and said tach signal, and control means providing a signal for said drive means in response to said difference signal, said pattern generator means including a read-only memory having a speed pattern stored therein, and addressing means for addressing the read-only memory in response to movement of the elevator car when the elevator car reaches a predetermined first distance from the desired stopping point, with the car movement increment which changes the address applied to the read-only memory being relatively large until the elevator car reaches a predetermined second distance from the desired stopping point, at which point the car movement increment which changes the address applied to the read-only memory is substantially reduced.

31. The elevator drive system of claim 30 wherein the tachometer means provides a pulse for each predetermined increment of car travel, and wherein the addressing means includes a first counter which addresses the read-only memory and a second counter, said second counter counting the pulses provided by the tachometer means, with the first counter being clocked by a predetermined output of the second counter until the predetermined second distance is reached, and then by the tachometer pulses.

32. The elevator drive system of claim 31 wherein the count on the second counter indicates when the second predetermined distance is reached.

33. An elevator system, comprising:

an elevator car, drive means for said elevator car, pattern generator means, said pattern generator means providing a speed pattern signal indicative of the desired speed of the elevator car, during at least a portion of a run, means providing a first train of pulses responsive to the movement of said elevator car, with the width of the pulses in the first train varying in response to the speed of the elevator car, means providing a second train of pulses in response to the first train of pulses, with said pulses in the second train having a constant width, means integrating said second train of pulses to provide a unidirectional signal responsive to car speed having a ripple component whose frequency is responsive to the pulse rate of the second train of pulses, timing means providing timing signals responsive to said first train of pulses, sample and hold means responsive to said timing means and to said unidirectional signal, said sample and hold means sampling and holding each cycle of the ripple frequency at a time determined by said timing means, to provide a substantially ripple-free actual speed signal, comparator means providing a difference signal responsive to the difference between said speed pattern signal and said actual speed signal, and control means responsive to said difference signal for controlling said drive means.

34. The elevator system of claim 33 wherein the means which provides the second train of pulses includes means responsive to the leading edges of the first train of pulses for providing the second train of pulses.

35. The elevator system of claim 34 wherein the timing means provides a timing pulse on the trailing edge of each of the first train of pulses.

* * * * *